US009220299B2

(12) United States Patent
Descamp

(10) Patent No.: US 9,220,299 B2
(45) Date of Patent: Dec. 29, 2015

(54) PORTION REGULATED MULTIPLE-BOWL SMOKING DEVICE

(75) Inventor: William Curtis Descamp, Woodway, TX (US)

(73) Assignee: William Curtis DesCamp, Pooler, GA (US)

( * ) Notice: Subject to any disclaimer, the term of this patent is extended or adjusted under 35 U.S.C. 154(b) by 997 days.

(21) Appl. No.: 13/385,224

(22) Filed: Feb. 7, 2012

(65) Prior Publication Data

US 2012/0204888 A1 Aug. 16, 2012

Related U.S. Application Data

(60) Provisional application No. 61/463,375, filed on Feb. 16, 2011.

(51) Int. Cl.

| | |
|---|---|
| ***A24F 1/26*** | (2006.01) |
| ***A24F 15/00*** | (2006.01) |
| ***A24F 1/06*** | (2006.01) |
| ***A24F 5/00*** | (2006.01) |

(52) U.S. Cl.
CPC .... *A24F 1/06* (2013.01); *A24F 5/00* (2013.01)

(58) Field of Classification Search
None
See application file for complete search history.

(56) References Cited

U.S. PATENT DOCUMENTS

| | | | |
|---|---|---|---|
| 5,850,838 | A | 12/1998 | Sigrist |
| 6,073,633 | A | 6/2000 | Herman |
| 6,196,232 | B1 | 3/2001 | Chkadua |
| 6,418,936 | B1 | 7/2002 | Lee |

*Primary Examiner* — Richard Crispino
*Assistant Examiner* — Phu Nguyen

(57) ABSTRACT

The present invention is a smoking device which departs from a traditional "bowl and stem" design utilized for centuries, and rather comprises a series of generally cylindrically shaped layers that when stacked and secured together provide the user an effective means to safely store, transport and smoke a plurality of smoking materials. The smoking device may incorporate a bowl selection ranging in number between seven (7) to an unlimited amount, depending upon the size, desired portability and intended use. A rotatable bowl selector dial which positions a flame inlet over one of the plurality of bowls in an adjacent smoking material retention cartridge offers a means for easy bowl selection. The user may draw from the plurality of smoking materials without inhaling smoke from, or through excess burnt ash. The smoking device may further be utilized as a practical means of proportionally and consistently regulating each draw of tobacco smoke.

48 Claims, 7 Drawing Sheets

( *FIG 3* )

( *SECT* IIV - IIV )

PORTION REGULATED MULTIPLE-BOWL SMOKING DEVICE

CROSS-REFERENCE TO RELATED APPLICATIONS

This application claims priority to Provisional Patent Application No. 61/463,375, filing date: Feb. 16, 2011.

STATEMENT REGARDING FEDERALLY SPONSORED RESEARCH AND DEVELOPMENT

Not Applicable.

FIELD OF THE INVENTION

This invention relates to smoking methods and apparatus; and more particularly to a novel and improved smoking device used for smoking tobacco.

DISCUSSION OF RELATED ART

Smoking pipes provide a lasting sense of pleasure and a form of relaxation. Traditional smoking pipes typically consist of a burning bowl, a stem or smoke draw passageway which is usually connected to the lower portion of the burning bowl, and a mouthpiece at the end of the stem. The bowl holds loose tobacco, that when lit by fire, can be used to smoke by drawing air through the mouthpiece.

As the fire consumes the tobacco, a combination of smoking material, resin and ash remain in the bowl. Eventually however, the smokers consume unpleasant smoke from built up resin and excess burnt ashes. This unpleasant smoke, mixed with the fresh smoking material, reduces the flavor and enjoyment of smoking. This further leaves the smoker unfulfilled and often causes the smoker to cough due to the harshness of the mixed smoke withdrawn from the smoking pipe. In addition, traditional smoking pipes do not offer a means to effectively regulate the amount of smoke inhaled. The smoker can easily over draw the amount of smoke, which again, may cause unpleasant coughing due to over-consumption and expansion of the smoke within the mouth or lungs. Traditional smoking pipes further require the smoker to reload the pipe constantly after each bowl of smoking material has been consumed, requiring a need for an additional means of tobacco storage. Although some smoking pipes have incorporated an additional storage compartment for the smoking material within the pipe's body, the process of constantly reloading the material often becomes messy, cumbersome, wasteful and time consuming. Moreover, traditional smoking pipes tend to omit odor from either stored, un-smoked smoking material, or burnt ash and resin buildup within the smoking bowl. Finally, traditional smoking pipes typically utilize a small, bowl-sized screen to filter the smoke from the burning tobacco. As the smoke from one or more bowl(s) is forced to flow through the small filtering screen, residual heat and resins quickly build up producing a restricted smoke path, undue strain and disproportionate distortion upon the screen filter. Many traditional smoking pipes may further completely eliminate a means of filtering altogether, subjecting the draw hole to unnecessary contamination and hot embers to inadvertently be drawn into a user's mouth.

U.S. Pat. No. 6,418,936 issued to Lee on Jul. 16, 2002 discloses a smoking pipe that includes a more traditional style long stem coupled to a manifold with a removably attached turret that is configured with six (6) smoking bowls therein and rotates freely upon the top of the manifold. The smoker may use various smoking materials, however because the smoking pipe depends upon the weight of the brass bowl to function properly, along with its bulky design, it is difficult to be carried comfortably in one's pocket. In addition, the design does not accommodate a mechanical means to align and maintain alignment of the turret with the manifold along a longitudinal axis. Moreover, the smoking pipe does not provide a practical method to regulate the amount of smoke inhaled per draw. The smoking pipe further requires special tools to assemble and disassemble for cleaning and screen replacement and does not have the capability to practically store additional smoking material without the loss of such material during transportation of the pipe. Finely, the smoking pipe channels smoke from all six of its bowl chambers through a single bowl-sized screen, thereby subjecting the screen to excessive clogging and heat buildup which demands the inconvenience of more frequent cleaning and replacement intervals.

One prior art taught in U.S. Pat. No. 6,196,232 issued to Chkadua on Mar. 6, 2001 provides a smoking pipe that includes a base and a mouthpiece. The base includes a bowl for placement of loose tobacco and also includes a permanent neodymium magnet that is embedded within the base. The mouthpiece is a separate component and incorporates a permanent neodymium magnet embedded within the mouthpiece. The mouthpiece is generally movable between a smoking position and a transportation position relative to the base by means of detaching and repositioning the mouthpiece. The smoking pipe is of minimal dimensions, allowing for the pipe to be easily carried within the palm of the hand or in a shirt or pants pocket. However, the smoking pipe requires cleaning and reloading after each single bowl of smoking material has been consumed. Further, the smoking pipe does not provide the option for additional storage of desired smoking materials or a practical method to regulate the amount of smoke inhaled per draw.

Another prior art taught in U.S. Pat. No. 6,073,633 issued to Herman on Jun. 13, 2000 discloses a safety smoking pipe that includes first and second parts telescopically receivable, one within the other, and rotatable relative to one another. The first part includes an elongated tube having a screen adjacent one end. The second part includes an elongated tube terminating at its proximal end in a pipe tip and an axially extending cleaning member terminating in a cleaning head. The tobacco materials are loaded into the first tube. The tobacco materials adjacent to the screen end are lit and the ash is formed on the interior of the screen after the tobacco material is burned. By rotating the parts relative to one another, the cleaning head may clean the ash from the end of the pipe. By shaking the pipe screen end down, the weight repacks the tobacco material in the tube whereby the smoking material can once again be ignited. The smoking pipe incorporates a simplified method for cleaning and reloading and further includes a method to self extinguish itself after a determined amount of puffs. However, the design does not provide a practical method to extinguish itself immediately at the smoker's discretion or regulate the amount of smoke inhaled per draw.

Yet another prior art taught in U.S. Pat. No. 5,850,838 issued to Sigrist on Dec. 22, 1998 provides a smoking pipe having a rotatable coupling between a base including a bowl and mouthpiece. The mouthpiece rotates to a first position covering the bowl for storage and to a second position distant from the bowl for smoking the pipe. The collapsed form of the smoking pipe may be more easily carried in one's pocket without loss of debris from the bowl. However, disassembly of the smoking pipe for re-loading and cleaning is difficult.

Further, the smoking pipe does not address a practical method to regulate the amount of smoke inhaled per draw.

Therefore, there is a need for a smoking device that can accommodate a greater number of bowls for safely storing and smoking ground tobacco in a more precise and proportionally regulated manner. Such a smoking device would deliver a higher degree of quality smoke by allowing the smoker to take a fresh draw from the plurality of smoking materials without inhaling smoke from, or through excess resin or burnt ash. Such a smoking device would further incorporate a compact and spill proof design that can comfortably be carried in an individual's pocket or purse and may easily be cleaned by means of a common household dishwasher. Moreover, such a smoking device would incorporate a housing enclosure capable of nesting a pre-loaded and disposable smoking material retention cartridge, offering the smoker a more convenient, flexible and accurate means of smoking. Finally, such a smoking device would incorporate the use of a plurality of neodymium magnets to attach the components together and further propel the components apart for ease of assembly and disassembly along with a ball and dimple configuration to obtain precise flame inlet to bowl alignment. By departing from the classic "bowl and stem" pipe configuration utilized for centuries, the present invention accomplishes all these objectives.

SUMMARY OF THE INVENTION

It is therefore an object of the present invention to provide for a novel and improved method and means for storing and smoking a plurality of smoking materials. It is another object of the present invention to provide a novel and improved method and means for consistently and accurately measuring a proportioned amount of smoking material within a plurality of tobacco bowls that when lit by fire, may produce a proportionally regulated amount of smoke upon each draw taken.

It is further an object of the present invention to provide a novel and improved method for storing a plurality of smoking materials by means of a smoking material retention cartridge that may be pre-loaded and disposable after each use.

It is an additional object of the present invention to provide for a novel and improved method and means for a smoker to draw from a plurality of smoking materials without inhaling smoke from, or through excess resin or burnt ash wherein a much higher degree of quality smoke may be delivered.

It is still further an object of the present invention to provide for a novel and improved method and means for a smoker to immediately extinguish burning tobacco enabling the smoking device to be safely placed in a pocket or purse directly after use.

It is moreover an object of the present invention to provide for a novel and improved method and means for incorporating a plurality of bowls that may far greater exceed that of other smoking pipes.

In accordance with the present invention, a method and apparatus for smoking tobacco has been devised which is broadly comprised of a generally flat, cylindrical shaped bowl selector dial, a smoking material retention cartridge, a wire mesh filter element, and a bottom housing that may be stacked along a longitudinal axis and removably attached by a fastener. The bowl selector dial includes a flame inlet opening and a draw hole which is provided on a peripheral edge of the bowl selector dial diametrically opposite to the flame inlet opening, eliminating the need of a traditional "pipe stem" attached thereto. An annular groove, placed on the bottom surface of the bowl selector dial provides a method of evenly transferring smoke regardless of the rotated position of the bowl selector dial. A neodymium magnet may further be embedded on the bottom surface of the bowl selector dial to provide a means of attachment, alignment and a bearing surface when attached to the bottom housing. The smoking material retention cartridge is placed on the bottom surface of the bowl selector dial. The smoking material retention cartridge may further include a plurality of smoking material retention bores. The plurality of the smoking material retention bores are configured to easily store and maintain a precisely calculated and measured amount of ground smoking material thereby providing a practical solution in regulating the amount of smoke inhaled by the user. The plurality of the smoking material retention bores, commonly referred to as tobacco bowls, are formed by means of placing a plurality of cylindrically shaped bores in the smoking material retention cartridge, spaced equidistantly apart and in a generally annular orientation around the outside perimeter of the top surface of the smoking material retention cartridge. The plurality of smoking material retention bores may typically range in number between seven (7) to sixty (60) in a compact smoking device however may be unlimited in number depending upon the actual outside diameter of the smoking device and number of rows of smoking material retention bores included therein. The wire mesh filter element having a toroidal form and a central aperture is placed at the bottom surface of the smoking material retention cartridge. The singular wire mesh filter element may be adapted therewith to serve as a primary means of smoke filtration when said materials are ignited and consumed by fire. By adapting a single wire mesh filter element of a much larger diameter than traditional pipe screens along with the capability of simultaneously accommodating a multitude of formed tobacco bowls, unnecessary clogging, from excessive resin buildup may be greatly reduced. Moreover, the wire mesh filter element may be adapted to be easily cleaned by means of a common household dishwasher. The bottom housing placed below the wire mesh filter element may include a plurality of slots and an annular groove. The plurality of slots, and the annular groove may be formed to interconnect leaving a thin air gap when the wire mesh filter element and the smoking material retention cartridge is seated firmly in place. The thin air gap formed therein, may allow an unrestricted passage for smoke to travel from under the plurality of smoking bowls to further smoke passages. The bottom housing may be adapted to nest therein the wire mesh element and the smoking material retention cartridge. Moreover, the bottom housing may be likewise configured whereas the identical features of the top surface of the bottom housing may be mirrored on the bottom surface thus enabling an additional filter element, smoking material retention cartridge and bowl selector dial to be attached to the opposite side of the bottom housing, thereby doubling the storage and smoking capacity of the smoking device. In use, the bowl selector dial may easily be rotated by grasping the bottom housing with one hand, restricting it's movement, while further grasping the bowl selector dial with the other hand, wherein exerting a slight twisting motion upon the bowl selector dial may accurately position the flame inlet opening over one of the plurality of smoking material retention bores containing the smoking material placed therein. Flame inlet alignment over one of the plurality of the smoking material retention bores may be accurately achieved by means of a ball and dimple configuration placed on the bottom surface of the bowl selector dial and the top and bottom surface of the smoking material retention cartridge. Upon selection of a fresh bowl of smoking material, the tobacco is ignited through the flame inlet opening at the top surface of the bowl selector dial placed diametrically across from the draw hole.

As the user produces a small amount of suction at the draw hole, the fire flame burns and consumes the smoking material contained in one of the plurality of portion-regulated smoking material retention bores. The smoke moves downwards through the wire mesh filter element and passes through at least one of the plurality of outer slots formed within the bottom housing. The smoke continues passage through the intersecting annular groove and further intersects with at least one of the innermost grooves formed within the bottom housing. The smoke is then drawn upwards, returning through the wire mesh filter element, through the at least one opening in the smoking material retention cartridge and continuing a path of movement through the annular groove placed in the bottom surface of the bowl selector dial. Finally, the smoke is drawn out through the draw hole in the bowl selector dial which intersects with the annular groove in the bottom surface of the bowl selector dial and is ultimately inhaled by the user. The process may be simply repeated by rotating the flame opening of the bowl selector dial over any one of the plurality of smoking material retention bores containing a plurality of smoking materials or may be instantaneously terminated by rotating the flame opening of the bowl selector dial back over the at least one the park position. It is in this position that the smoking device may be safely transported in one's pocket or purse without worry of spillage of the smoking material or the presence of an open flame, burning ember, or residual smoke. Further, the smoking device may be manufactured to any size or bowl specification allowing the ability to pre-load an exact amount of smoking material based on the quantity, quality, and amount of smoke actually required or desired by the user per draw.

In one embodiment of the present invention, the bowl selector dial of the present invention may be replaced with an extendable bowl selector dial. The extendable bowl selector dial may broadly include a modified bowl selector dial with an attached pivotal cover. The pivotal cover having a generally flat and cylindrical form, may include a draw hole provided on a peripheral edge that when twisted to an open, locked and smokeable position, is located diametrically opposite to the at least one flame inlet opening of the modified bowl selector dial. The modified bowl selector dial, having a generally flat and cylindrical form, may include a flame inlet opening and an offset pivot point. A neodymium magnet may further be embedded in a central aperture placed on the bottom surface of the modified bowl selector dial to provide a means of attachment and alignment to the bottom housing of the present invention. In use, the extendable bowl selector dial may provide a method of further distancing the user's mouth from the flame inlet opening. Upon proper attachment of the extendable bowl selector dial to the bottom housing of the present invention, the pivotal cover may simply be rotated to a side, in a pivotal type movement exposing the flame inlet opening in the top surface of the modified bowl selector dial. The pivotal cover may further be locked in place by a plurality of neodymium magnets embedded therein the top surface of the modified bowl selector dial and the bottom surface of the pivotal cover. The extendable bowl selector dial may easily be rotated by grasping the bottom housing of the present invention with one hand, while further grasping the modified bowl selector dial with the other hand, wherein exerting a slight twisting motion upon the modified bowl selector dial may accurately position the flame inlet opening over one of the plurality of smoking material retention bores containing the smoking material placed therein. The smoking material is ignited through the flame inlet opening at the top surface of the modified bowl selector dial placed diametrically across from the draw hole when the pivotal cover is rotated to an open, locked and smokeable position. As the user produces a small amount of suction at the draw hole, the fire flame burns and consumes the smoking material contained in one of the plurality of portion-regulated smoking material retention bores of the present invention. As the smoke travels throughout the lower portion of the present invention, the smoke continues a path of movement through the annular groove placed in the bottom surface of the modified bowl selector dial. The smoke is then drawn upward though the at least one opening in the top surface of the modified bowl selector dial and into the at least one opening on the bottom surface of the pivotal cover, further being drawn in and through the smoke draw passage within the pivotal cover. The smoke thereafter exits through the at least one opening placed on the outside peripheral edge of the pivotal cover and ultimately is inhaled by the user. The process may be simply repeated by rotating the flame opening of the modified bowl selector dial over any one of the plurality of smoking material retention bores of the present invention, containing a plurality of smoking materials nested therein. When the smoker is satisfied, the modified bowl selector dial may simply be rotated to the at least one park position completely enclosing the smoking device. For storage or transportation, the pivotal cover may be then rotated back over the modified bowl selector dial, in a reverse pivotal motion, and again locked in place by means of a plurality of neodymium magnets embedded therein. The present invention and accompanying embodiment allow a user to take a fresh portion-regulated draw from the plurality of smoking materials without inhaling smoke from, or through excess burnt ash or resin.

The above and other objects, features and advantages of the present invention will become apparent, understood and be more readily appreciated from the following more detailed description of preferred and alternate embodiments thereof when taken in conjunction with the accompanying drawings, which illustrate, by way of example, the principles of the invention.

DESCRIPTION OF THE DRAWINGS

In the accompanying drawings.

DETAILED DESCRIPTION OF THE PREFERRED EMBODIMENT

Figure 1:
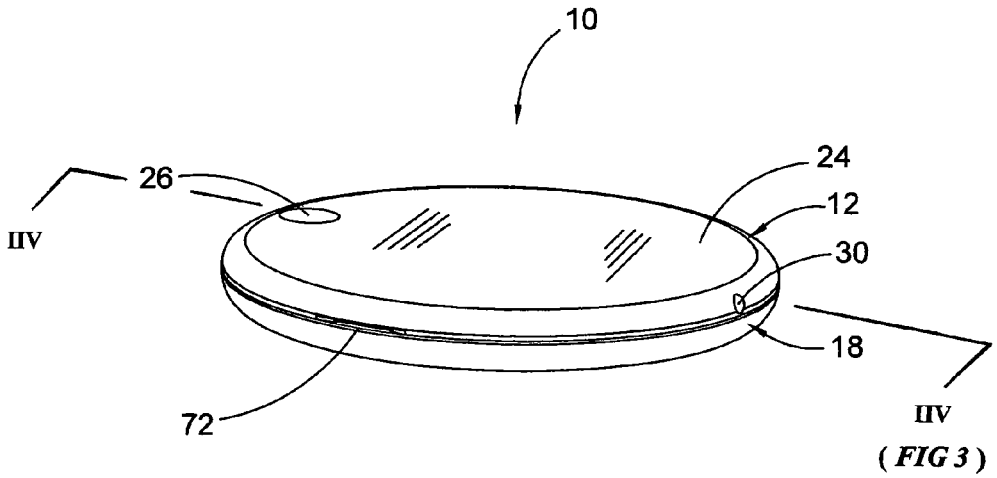
FIG. 1 is a perspective view of the present invention, illustrating a smoking device.

FIG. 1 is a perspective view of the present invention 10, illustrating a smoking device 10. The smoking device 10 comprises at least one bowl selector dial 12, at least one smoking material retention cartridge (not shown), a wire mesh filter element (not shown), and at least one bottom housing 18 that when stacked and secured together by at least one fastener (not shown) may provide a user an easy method to measure, load, safely store and smoke a precise and regulated amount of smoking material (not shown). The smoking device 10 may be manufactured to a physical size and bowl specification that may allow a virtually unlimited ability to personalize the device according to individual smoking preferences.

Figure 2:
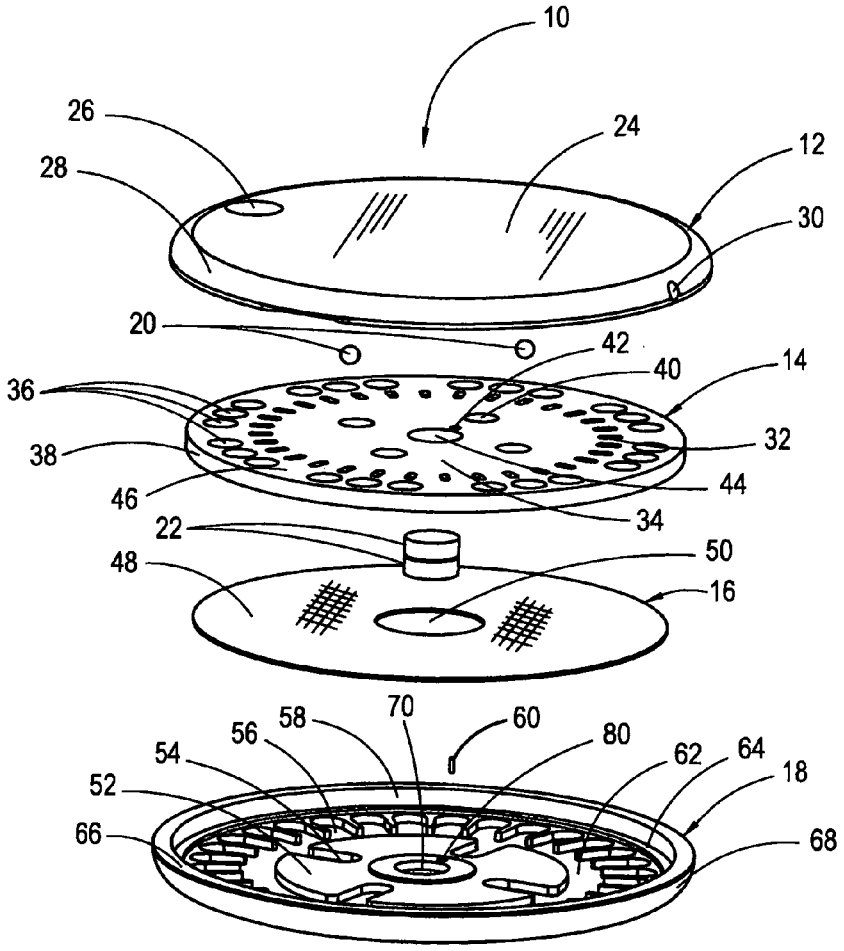
FIG. 2 is an exploded perspective view of the present invention, illustrating a top surface of the at least one bowl selector dial, the at least one smoking material retention cartridge, the at least one wire mesh filter element, the at least one bottom housing, the at least one anti-rotation pin and the at least one fastener to attach the assembly.

FIG. 2 is an exploded view of the present invention 10, illustrating a smoking device 10. The bowl selector dial 12, having a generally flat, cylindrical shape, includes a top surface 24, a bottom surface 78, a flame inlet opening 26, an opening 74, a central aperture 86, an annular groove 76, an outer peripheral edge 28 and a draw hole 30. The draw hole 30 may be provided on a peripheral edge 28 of the bowl selector dial 14 diametrically opposite to the flame inlet opening 26. The draw hole 30 may extend internally though the bowl selector dial 12 and intersect with the annular groove 76. The annular groove 76, placed on the bottom surface 78 of the bowl selector dial 12, may have at least one opening (not shown) thereof. At least one neodymium magnet 22 may further be partially embedded in the central aperture 86 placed on the bottom surface 78 of the bowl selector dial 12 to provide a means of attachment, alignment and a bearing surface. Moreover, at least one ball bearing 20 may be partially embedded in the at least one opening 74 placed in the bottom surface 78 of the bowl selector dial 12 which may removably seat in at least one of the plurality of dimple recesses 32 placed on the top surface 34 and the bottom surface (not shown) of the smoking material retention cartridge 14, providing an accurate means of flame inlet opening 26-to-smoking material retention bore 36 alignment. Still further, the outer peripheral edge 38 of the bowl selector dial 12 may be configured to include a knurled or irregular surface (not shown) to aid in gripping while maintaining a comfortable fit around a user's mouth. Additionally, the bowl selector dial 12 may include at least one finger nail slot 72 to aid in parting the bowl selector dial 12 from the bottom housing 18. The bowl selector dial 12 may have a thickness ranging between 0.1 cm and 5.0 cm and a diametric measurement ranging between 5.0 cm and 183.0 cm.

Figure 3:
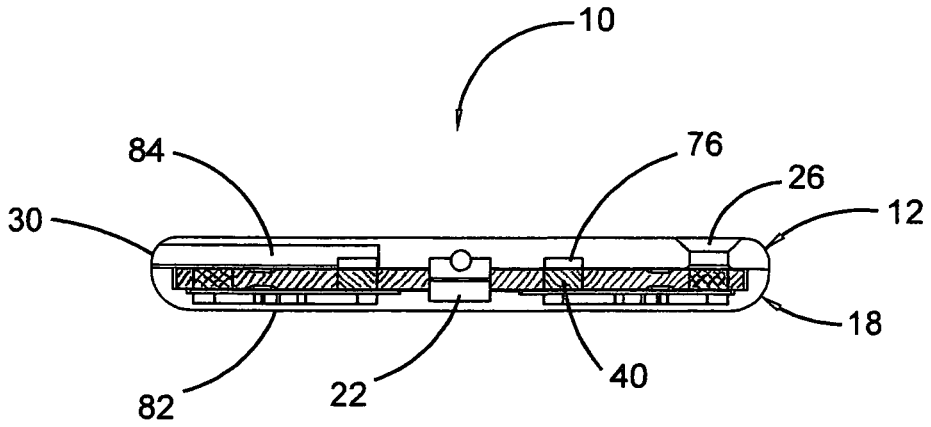
FIG. 3 is a cross sectional view (IW) of the present invention taken from FIG. 1.
Figure 4:
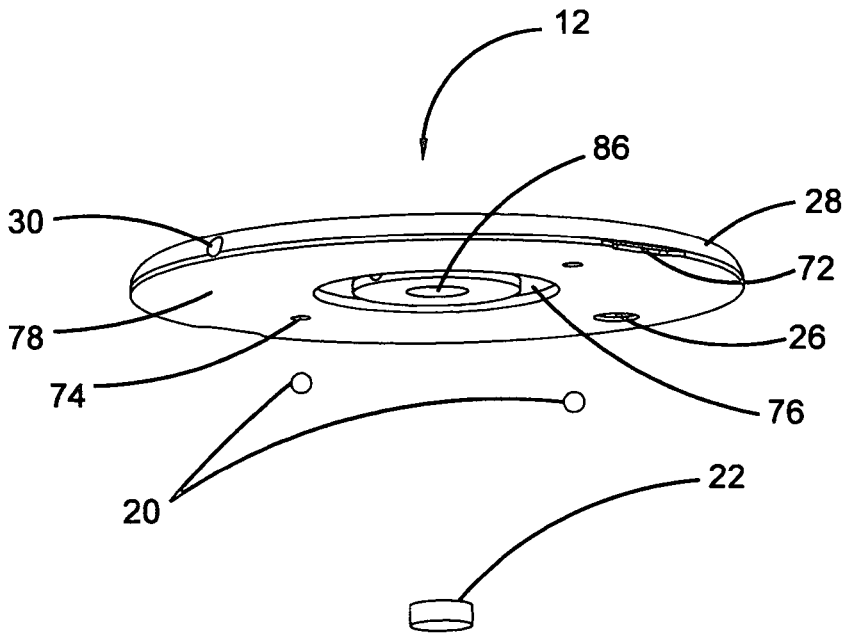
FIG. 4 is an exploded perspective view of the bottom surface of the at least one bowl selector dial illustrating at least one detached ball and at least one neodymium magnet.
Figure 5:
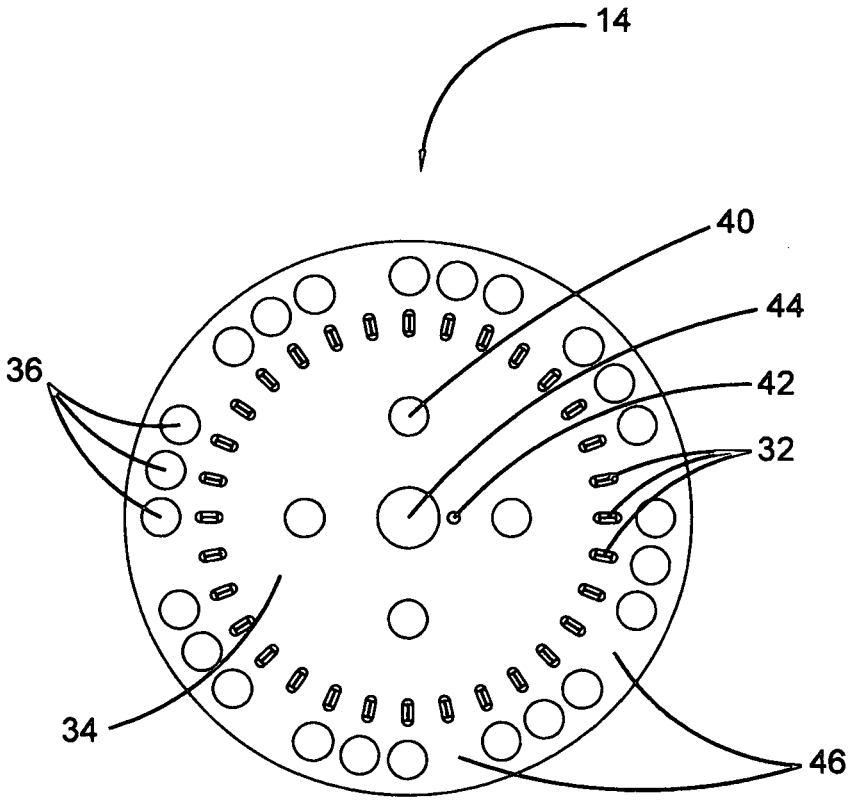
FIG. 5 illustrates a top view of the smoking material retention cartridge.
Figure 6:
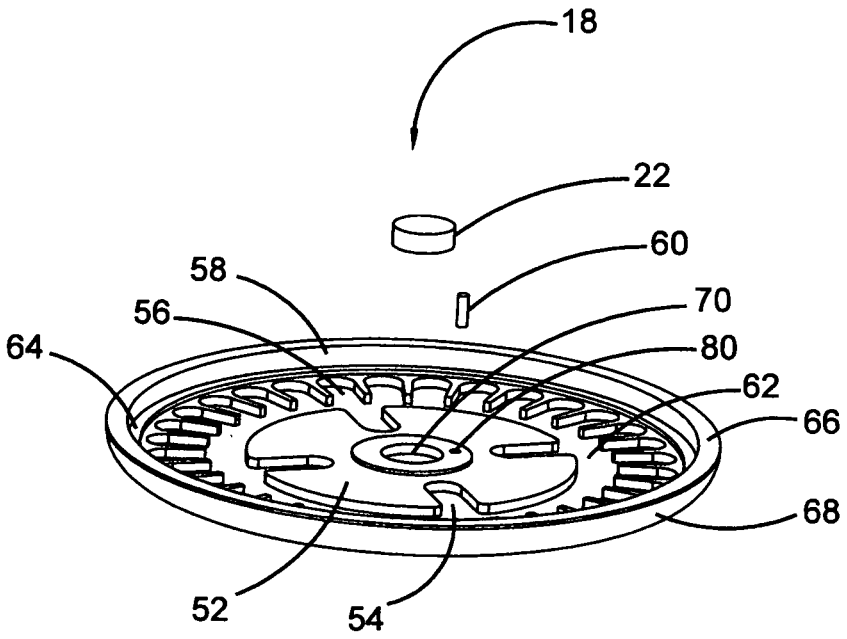
FIG. 6 is an exploded perspective view of the top surface of the at least one bottom housing illustrating at least one detached anti-rotation pin and at least one neodymium magnet.

The smoking material retention cartridge 14, as illustrated in FIG. 2, FIG. 3 and FIG. 5, having a generally flat, cylindrical shape, a top surface 34, a bottom surface (not shown), and an outer peripheral edge 38 is placed on the bottom surface (not shown) of the bowl selector dial 12. The smoking material retention cartridge 14 may be adapted to easily load into the bottom housing 18 with either the top surface 34 or the bottom surface (not shown) facing upwards by means of placing identical features therein both the top surface 34 and the bottom surface (not shown) of the smoking material retention cartridge 14. The smoking material retention cartridge 14 may further include at least one smoke passage opening 40, at least one anti-rotation pin retention bore 42, a central aperture 44 and a plurality of smoking material retention bores 36. The plurality of the smoking material retention bores 36 are configured to easily store and maintain a precisely calculated and measured amount of ground smoking material (not shown) thereby providing a practical solution in regulating the amount of smoke (not shown) inhaled by the user (not shown). The plurality of smoking material retention bores 36, commonly referred to as tobacco bowls 36, are formed by means of placing a plurality of cylindrically shaped bores 36 in the smoking material retention cartridge 14, spaced equidistantly apart and in a generally annular orientation around the outside perimeter of the top surface 34 of the smoking material retention cartridge 14. The plurality of smoking material retention bores 36 may be configured in an orientation perpendicular or angular to the face of the top surface 34 of the smoking material retention cartridge 14 and may be open at each end. The plurality of the smoking material retention bores 36 may thereafter be encapsulated at one end by placing the mesh filter element 16 firmly against the bottom surface (not shown) of the smoking material retention cartridge 14, forming a plurality of smoking bowls 36 therein. The plurality of smoking material retention bores 36 placed therein the at least one smoking material retention cartridge 12 may be configured to any size or shape and maintain a bore quantity of seven (7) or greater. At least one of the smoking material retention bore locations 46 may be kept blank to act as a closed-off and storable position 46, referenced hereinafter as a "park" position 46. When the flame inlet 26 is rotated and locked over the at least one park position 46, the smoking device 10 may remain completely enclosed, thereby eliminating the danger of exposed burning tobacco left un-contained and further preventing residual smoke (not shown) from exiting the smoking device 10 while being stored or transported. Still further, the smoking material retention cartridge 14 may be manufactured to various thicknesses (not shown) allowing the smoking material retention bore capacity (not shown) to be uniquely tailored to each individual's preference or intended use. The at least one smoke passage opening 40 may be of identical dimension in width as to the annular groove (not shown) and smoke passages (not shown) placed in the adjoining components and may further be configured to allow smoke (not shown) to pass upwardly through the smoking material retention cartridge 14 without restriction. A plurality of ball dimple recessions 32 may be placed in the top surface 34 and the bottom surface (not shown) of the smoking material retention cartridge 14 to maintain accurate flame inlet 26-to-smoking material retention bore 36 alignment, wherein the at least one ball bearing 20 embedded in the bottom surface (not shown) of the bowl selector dial 12 may become removably engaged. Still further, the at least one anti-rotation pin retention bore 42 may be placed in an orientation perpendicular to the face of the top surface 34 of the smoking material retention cartridge 14 and may be open at each end. Moreover, the at least one anti-rotation pin retention bore 42 may be configured to accept at least one anti-rotation pin 60 partially embedded therein the inner surface (not shown) of the bottom housing 18, thereby preventing unsolicited rotation of the smoking material retention cartridge 14 within the bottom housing 18. Still further, the outer peripheral edge 38 may be configured in an orientation perpendicular to the face of the top surface 34 of the smoking material retention cartridge 14. The smoking material retention cartridge 14 may have a thickness ranging between 0.1 cm and 5.0 cm and a diametric measurement ranging between 5.0 cm and 183.0 cm.

The wire mesh filter element as illustrated in FIG. 2 and FIG. 3, having 16 having a toroidal form, a top surface 48, a bottom surface (not shown), and a central aperture 50 is placed at the bottom surface (not shown) of the smoking material retention cartridge 14. While requiring no movement of a turret (not shown) configured with a plurality of tobacco bowls (not shown), or similar type of rotatable device (not shown) placed in direct contact or relationship to the top surface 48 or the bottom surface (not shown) of said wire mesh filter element 16, the singular wire mesh filter element 16 may act as a stand-alone means of simultaneously covering the lower portion (not shown) of each individual smoking material retention bore 36, of the smoking material retention cartridge 14, thereby forming a plurality of tobacco bowls 36 thereof. Each of the plurality of said tobacco bowls 36 may retain therein a plurality of fresh smoking material particles (not shown) or consumed smoking material ash particles (not shown). In conjunction with serving the purpose of securely retaining said smoking material particles (not shown) within the plurality of said smoking material retention bores 36, the singular wire mesh filter element 16 may further be adapted therewith to serve as a primary means of smoke filtration when said materials (not shown) are ignited and consumed by fire. By adapting the single wire mesh filter element 16 to simultaneously accommodate a multitude of formed tobacco bowls 36, unnecessary clogging, undue strain and disproportionate distortion created from excessive heat and resin buildup thereon, of the wire mesh filtering element 16, may thereby be greatly reduced. The central aperture 50 of the wire mesh filter element 16 may be adapted to center the wire mesh filter element 16 within the bottom housing 18 and may further provide a means for attachment hardware 22 to pass through.

Moreover, the wire mesh filter element 16 may be adapted to be easily cleaned by means of a common household dishwasher (not shown). Still further, the wire mesh filter element 16 may be composed of common mesh filtering materials selected from a group consisting of alloys such as stainless steel, brass, titanium and glass. The wire mesh filter element 16 may have a diametric measurement ranging between 5.0 cm and 183.0 cm and the central aperture 50 of the wire mesh filter element may further have a diametric measurement ranging between 0.33 cm and 60.0 cm. Finally, the wire mesh filter element 16 may be formed to a circumference that may simultaneously cover all of the plurality of said smoking material retention bores 36 placed therein the at least one said smoking material retention cartridge 14 without exceeding the outer circumference of the at least one said smoking material retention cartridge 14.

The bottom housing 18 placed below the wire mesh filter element 16, as illustrated in FIG. 1, FIG. 2, FIG. 3, and FIG. 6, having a generally flat and cylindrical form, includes a top peripheral annular landing 66, a top inner surface (not shown), a bottom surface 82, at least one anti-rotation pin 60, a central aperture 70 and an outer peripheral edge 68. The outer peripheral edge 68 of the bottom housing 18 may include a knurled or irregular surface (not shown) that may be easily grasped by one's hand to secure the bottom housing 18 while rotation of the bowl selector dial 12 occurs. A neodymium magnet 22 may further be embedded in the central aperture 70 on the top inner surface (not shown) of the bottom housing 18. The neodymium magnet 22 embedded therein may be utilized as a method of fastening the bowl selector dial 12 to the bottom housing 18 while further providing a method of maintaining proper bowl selector dial 12, smoking material retention cartridge 14 and bottom housing 18 alignment. Still further, the adjoining neodymium magnets 22 may be configured to form a centralized bearing surface (not shown) thereof, in which the bowl selector dial 12 may be rotated freely. The top annular peripheral landing 66 may additionally provide a bearing surface (not shown) for the bowl selector dial 12 to rotate and rest thereon. The top inner surface (not shown) of the bottom housing 18 may include at least one anti-rotation pin 60 embedded partially therein whereas to prevent movement of the smoking material retention cartridge 14 within the bottom housing 18. Moreover, the top inner surface (not shown) of the bottom housing 18 may include a plurality of inner slots 54, a plurality of outer slots 56, an annular groove 62, an inner annular peripheral landing 64, an annular vertical surface 58, and an inner recessed landing 52. The plurality of inner slots 54, a plurality of outer slots 56, and the annular groove 62 may be formed to interconnect leaving a thin air gap (not shown) when the wire mesh filter element 16 and the smoking material retention cartridge 14 is seated firmly in place. The thin air gap formed therein (not shown), may allow an unrestricted passage for smoke to travel from under the plurality of smoking bowls 36 to further smoke passages (not shown). The inner annular peripheral landing 64 and the inner annular vertical surface 58 may provide a means of nesting the smoking material retention cartridge 14 within the bottom housing 18 and may further be configured to prevent unsolicited air movement therein. The inner recessed landing 52 may be adapted to accept and secure the wire mesh filter element 16 as to where the wire mesh filter element 16 may sit flush below the smoking material retention cartridge 14 when placed within the bottom housing 18, thus allowing smoke to pass freely beneath. The inner recessed landing 52 may further be configured whereas to equally support the wire mesh filter element 14 snugly against the bottom surface (not shown) of the smoking material retention cartridge 14. Additionally, the bottom housing 18 may be likewise configured whereas the identical features of the top surface (not shown) of the bottom housing 18 may be mirrored on the bottom surface (not shown) thus enabling an additional filter element 16, smoking material retention cartridge 14 and bowl selector dial 12 to be attached to the opposite side (not shown) of the bottom housing 18, thereby doubling the storage (not shown) and smoking capacity of the smoking device 10. The bottom housing 18 may have a thickness ranging between 0.1 cm and 5.0 cm and a diametric measurement ranging between 5.0 cm and 183.0 cm. Still further, the bottom housing 18 may be optionally formed to allow encroachment of the smoking material retention cartridge 14 to a position flush with the outer peripheral edge 68 of the bottom housing 18 and the outer peripheral edge 28 of the bowl selector dial 12 thereby eliminating the nesting wall of the bottom housing 18.

The bowl selector dial 12, the smoking material retention cartridge 14 and the bottom housing 18 may be composed of one or more materials selected from a group consisting of alloys such as aluminum, titanium, stainless steel, and brass, as well as non-metallic materials such as wood, various high temperature plastics, glass, or compressed paper products. Moreover, the smoking device 10 may include a foil type casing (not shown) composed of one or more materials selected from a group consisting of alloys such as aluminum, titanium, stainless steel, or brass that may provide further protection to areas subjected to direct flame or excessive heat.

The components used to attach or align the bowl selector dial 12, the smoking material retention cartridge 14, the wire mesh filter element 16, and the bottom housing 18 may be selected from a group of materials consisting of neodymium magnets, rivets, screws, bolts, roll pins, pins, ball plungers, ball bearings and other common fastening or alignment devices.

In use, referring to FIGS. 1 thru 6, the bowl selector dial 12 may easily be rotated by grasping the bottom housing 18 with one hand, restricting it's movement, while further grasping the bowl selector dial 12 with the other hand, wherein exerting a slight twisting motion upon the bowl selector dial 12 may accurately position the flame inlet opening 26 over one of the plurality of smoking material retention bores 36 containing the smoking material placed therein (not shown). The bowl selector dial 12 may further be easily rotated by means of a knurled or irregular peripheral edge (not shown). Flame inlet 26 alignment over one of the plurality of the smoking material retention bores 36 may be accurately achieved by means of a ball and dimple configuration 20, 32 placed on the bottom surface 78 of the bowl selector dial 12 and the top surface 34 and bottom surface (not shown) of the smoking material retention cartridge 14. Moreover, the bowl selector dial 12 may incorporate markings (not shown) that align with similar markings (not shown) located on the outside peripheral edge 68 of the bottom housing 18 to notate the position of the rotated modified bowl selector dial 12 by means such as numerical 1, 2, 3 etc., or by other similar methods.

Upon selection of a fresh bowl of tobacco (not shown), the smoking material is ignited through the flame inlet opening 26 at the top surface 24 of the bowl selector dial 12 placed diametrically across from the draw hole 30. As the user (not shown) produces a small amount of suction at the draw hole 30, the fire flame burns and consumes the smoking material (not shown) contained in one of the plurality of portion-regulated smoking material retention bores 36. The smoke (not shown) moves downwards through the wire mesh filter element 16 and passes through one of the plurality of outer slots 56 formed therein the bottom housing 18. The smoke (not shown) continues passage around the intersecting annular groove 62 and further intersects with at least one of the innermost grooves 54 formed within the bottom housing 18. The smoke (not shown) is then drawn upwards returning through the wire mesh filter element 16, through the at least one opening 40 in the smoking material retention cartridge 14 and continuing a path of movement through the annular groove 76 placed in the bottom surface 78 of the bowl selector dial 12. Finally, the smoke (not shown) is drawn out through the draw hole 30 in the bowl selector dial 12 which intersects with the annular groove 76 in the bottom surface 78 of the bowl selector dial 12 and ultimately inhaled by the user (not shown). The process may be simply repeated by rotating the flame opening 26 of the bowl selector dial 12 over any one of the plurality of smoking material retention bores 36 containing a plurality of smoking materials (not shown) or may be instantaneously terminated by rotating the flame opening 26 of the bowl selector dial 12 back over the at least one the park position 46. It is in this position that the smoking device 10 may be safely transported in one's pocket or purse (not shown) without worry of spillage of the smoking material (not shown) or the presence of an open flame, burning ember, or residual smoke. The smoking device 10 may be manufactured to any size or bowl specification allowing the ability to pre-load an exact amount of smoking material (not shown) based on the quantity, quality, and amount of smoke actually required or desired by the user per draw. Further, a plurality of neodymium magnets (not shown) may be embedded in the bottom surface 78 of the bowl selector dial 12 and in the top peripheral surface 66 of the bottom housing 18 placed in a configuration whereas a field of magnetic repulsion (not shown) may be adapted to aid separation of the bowl selector dial 12 from the bottom housing 18 for cleaning and reloading.

Figure 7:
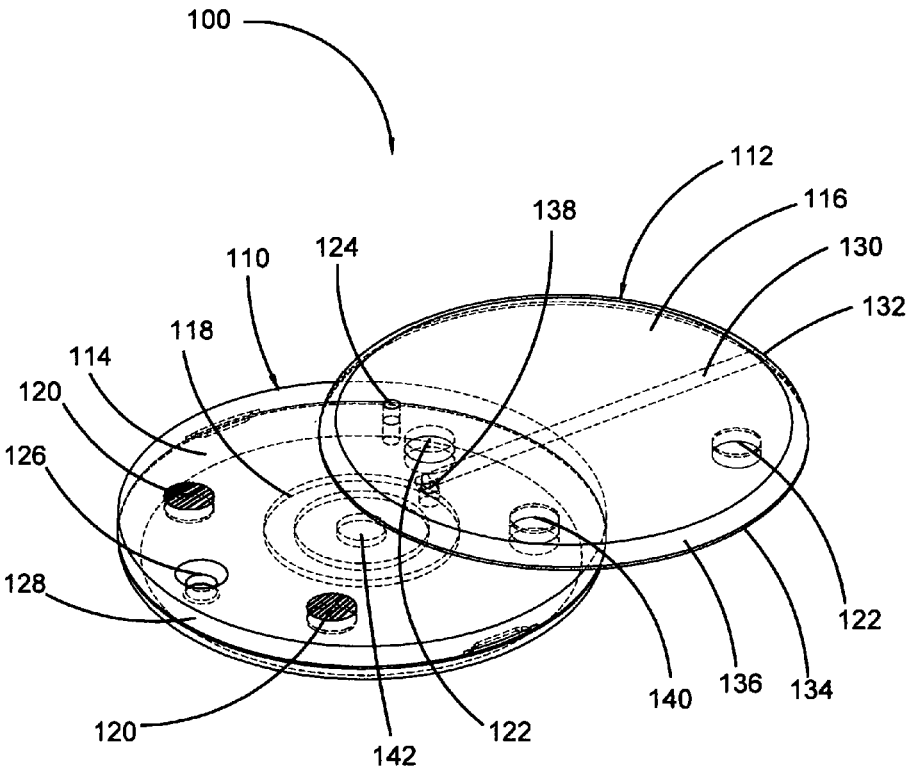
FIG. 7 is a perspective view of the embodiment of the present invention illustrating an extendable bowl selector dial placed in the open and smokeable position.

Referring to FIG. 7, an embodiment 100 of the present invention 10 is illustrated depicting a perspective view of an extendable bowl selector dial 100 situated in the open and smokeable position. The extendable bowl selector dial 100 includes a modified bowl selector dial 110 with an attached pivotal cover 112.

The pivotal cover 112 having a generally flat and cylindrical form, may include a top surface 116, a bottom surface (not shown), at least one offset pivot point 124, a smoke passage 130, an opening that intersects perpendicular with the smoke passage 138, a peripheral knurled or irregularly shaped edge 134, a draw hole 132 and a plurality of neodymium magnets embedded therein 120, 122, 140. The draw hole 132 may be provided on a peripheral edge 136 of the pivotal cover 112, that when twisted to an open, locked and smokeable position, is located diametrically opposite to the at least one flame inlet opening 126 of the modified bowl selector dial 110. The draw hole 132 may further extend internally through the pivotal cover 112, towards the flame inlet opening 126 of the modified bowl selector dial 110, and intersect with the opening 138 on the bottom surface (not shown) of the pivotal cover 112. The at least one opening 138 of the pivotal cover 112 may be open at the bottom surface (not shown) and configured in an orientation perpendicular to the face of the bottom surface (not shown) of the pivotal cover 112. The at least one opening (not shown) of the modified bowl selector dial 110 and the at least one opening of the pivotal cover 138 may be aligned along a longitudinal axis when stacked together and rotated to an open, locked and smokeable position.

The modified bowl selector dial 110, having a generally flat and cylindrical form, may include a top surface 114, a bottom surface (not shown), a flame inlet opening 126, a central aperture 142, an annular groove 118, an offset pivot point 124, an outer peripheral edge 128, a plurality of neodymium magnets 120, 122, and at least one opening to act as a smoke passage 138. A neodymium magnet (not shown) may further be embedded in the central aperture 142 on the bottom surface (not shown) of the modified bowl selector dial 110 to provide a means of attachment and alignment. Moreover, at least one ball bearing (not shown) may be embedded in the bottom surface (not shown) of the modified bowl selector dial 110 which may removably seat in at least one of the plurality of dimple recesses 32 (FIG. 5) placed on the top surface 34 (FIG. 5) and bottom surface (not shown) of the smoking material retention cartridge 14 (FIG. 5) providing an accurate means of flame inlet opening 126 to smoking material retention bore 36 (FIG. 5) alignment. The annular groove 118, placed on the bottom surface (not shown) of the modified bowl selector dial 110, may have at least one opening 138 thereof. The at least one opening 138 may be configured in an orientation perpendicular to the face of the bottom surface (not shown) of the modified bowl selector dial 110 and may be open at each end.

The pivotal cover 112 and the modified bowl selector dial 110 may be fastened at the offset pivot point 124 by means of a screw, rivet or other like fastener and may further include a plurality of neodymium magnets 120, 122, 140 embedded therein the top surface 114 of the modified bowl selector dial 110 and the bottom surface (not shown) of the pivotal cover 112 to limit over-rotation and to secure the components in either the open or closed position.

In use, referring to FIGS. 1 thru 7, the bowl selector dial 12 of the present invention 10 may be replaced with the extendable bowl selector dial 100 to provide a method of zo further distancing the user's mouth (not shown) from the flame inlet opening 126. Upon proper attachment of the extendable bowl selector dial 100 to the bottom housing 18 of the present invention 10, the pivotal cover 112 may simply be rotated to a side, in a pivotal type movement, by means of a knurled or irregularly shaped edge 134, exposing the flame inlet opening 126 in the top surface 114 of the modified bowl selector dial 110. The pivotal cover 112 may further be locked in place by a plurality of neodymium magnets 120, 122, 140 embedded therein the top surface 114 of the modified bowl selector dial 110 and the bottom surface (not shown) of the pivotal cover 112. The extendable bowl selector dial 100 may easily be rotated by grasping the bottom housing 18 of the present invention 10 with one hand, while further grasping the modified bowl selector dial 110 with the other hand, wherein exerting a slight twisting motion upon the modified bowl selector dial 110 may accurately position the flame inlet opening 126 over one of the plurality of smoking material retention bores 36 containing the smoking material (not shown) placed therein. The modified bowl selector dial 110 may be easily rotated by means of a knurled or irregular peripheral edge 134 and flame inlet 126 alignment over one of the plurality of the smoking material retention bores 36 may be accurately achieved by means of a ball and dimple configuration 20, 32 placed on the bottom surface (not shown) of the modified bowl selector dial 110 and the top surface 34 and the bottom surface (not shown) of the smoking material retention cartridge 14 of the present invention 10. Moreover, the modified bowl selector dial 110 may incorporate markings (not shown) that align with similar markings (not shown) located on the outside peripheral edge 68 of the bottom housing 18 of the present invention 10 to notate the position of the rotated modified bowl selector dial 110 by means such as numerical 1, 2, 3 etc., or by other similar methods. When rotated to the extended smoking position, the at least one opening 138 in the pivotal cover 112 may come into alignment along a longitudinal axis with the at least one opening (not shown) in the modified bowl selector dial 110 to form an extended smoke passage (not shown).

The smoking material (not shown) is ignited through the flame inlet opening 126 at the top surface 114 of the modified bowl selector dial 110 placed diametrically across from the draw hole 132 when the pivotal cover 112 is rotated to an open, locked and smokeable position. As the user (not shown) produces a small amount of suction at the draw hole 132, the fire flame burns and consumes the smoking material (not shown) contained in one of the plurality of portion-regulated smoking material retention bores 36. As the smoke (not shown) travels throughout the lower portion of the smoking device (not shown), the smoke (not shown) continues a path of movement through the annular groove 118 placed in the bottom surface (not shown) of the modified bowl selector dial 110. The smoke (not shown) is then drawn upward though the at least one opening (not shown) in the top surface 114 of the modified bowl selector dial 110 and into the at least one opening 138 on the bottom surface (not shown) of the pivotal cover 112, further being drawn in and through the smoke draw passage 130 within the pivotal cover 112. The smoke (not shown) thereafter exits through the at least one opening 132 placed on the outside peripheral edge 130 of the pivotal cover 112 and ultimately is inhaled by the user (not shown). The process may be simply repeated by rotating the flame opening 126 of the modified bowl selector dial 110 over any one of the plurality of smoking material retention bores 36, containing a plurality of smoking materials (not shown) nested therein. When the smoker is satisfied, the modified bowl selector dial 110 may simply be rotated to the at least one park position 46 by means of a knurled or irregularly shaped edge 128, completely enclosing the smoking device 10. For storage or transportation, the pivotal cover 112 may be then rotated back over the modified bowl selector dial 110, in a reverse pivotal motion, and again locked in place by means of a plurality of neodymium magnets 120, 122, 140 embedded therein. It is in this position that the smoking device 10 may be safely transported in one's pocket or purse without worry of spillage of the smoking material (not shown) or the presence of an open flame, burning ember, or residual smoke.

A plurality of neodymium magnets 140 may further be embedded in the top surface 114 of the modified bowl selector dial 110 and in the bottom surface (not shown) of the pivotal cover 112 to limit over rotation of the pivotal cover 112 when rotated to an open and locked position. Moreover, a Teflon or similar washer (not shown) may be provided on the bottom surface (not shown) of the modified bowl selector dial 110 to facilitate smooth rotation of the modified bowl selector dial 110.

While a particular form of the invention has been illustrated and described, it will be apparent that various modifications may be made without departing from the spirit and scope of the invention. For example, an irregular surface may be provided on the top inner surface of the bottom housing to filter the smoke in place of the wire mesh filter element and the plurality of outer grooves. Accordingly, it is not intended that the invention be limited, except as by the appended claims.

What is claimed is:

1. A multiple-bowled smoking device adapted to measure, store, burn and smoke consistent portions of smoking material within a plurality of uniformly sized smoking bowls comprising:

a bowl selector dial having a top surface, a bottom surface, a peripheral edge, at least one flame inlet opening, a central aperture, a draw hole and at least one annular groove having at least one opening thereof;

a smoking material retention cartridge placed at the bottom surface of the bowl selector dial having a top surface, a bottom surface, a peripheral edge, at least one opening, a central aperture, a plurality of bores and at least one blank segment;

at least one wire mesh filter element placed at the bottom surface of the smoking material retention cartridge having a top surface, a bottom surface, a peripheral edge, and a central aperture; and a bottom housing having a top surface, a bottom surface, a peripheral edge, at least one anti-rotation pin, a central aperture, a plurality of grooves, and an annular groove; the bottom housing being placed adjacent to the at least one said wire mesh filter element, the said smoking material retention cartridge and the said bowl selector dial;

whereby said bowl selector dial, said smoking material retention cartridge, at least one said wire mesh filter element, and said bottom housing are stacked and secured together by at least one fastener which provides therein a plurality of smoke passages through which smoke travels, from at least one said smoking bowl to said draw hole of said bowl selector dial, by way of passing through at least one said grove in said bottom housing, at least one opening in at least one said wire mesh filter element, at least one said bore in said smoking material retention cartridge, and at least one said annular grove of said bowl selector dial, intersecting therewith said draw hole of said bowl selector dial;

whereby, said smoke travels therethrough said passages regardless of the rotated orientation of said bowl selector dial, when at least one said flame inlet of said bowl selector dial is positioned along a longitudinal axis over at least one said smoking bowls by way of rotation of said bowl selector dial to allow a user an easy way to load, store and smoke a precise and regulated amount of ground smoking material.

2. The smoking device as recited in claim 1 wherein said bowl selector dial, said smoking material retention cartridge, at least one said wire mesh filter element, and said bottom housing is aligned along a longitudinal axis and fastened by at least one of the components selected from a group of materials consisting of neodymium magnets, rivets, screws, bolts, and/or other common fastening devices.

3. The smoking device as recited in claim 2 wherein at least one said neodymium magnet is partially embedded therein said central aperture of said bowl selector dial and therein said bottom housing configured to provide at least one bearing surface and a method of attachment, whereby; said smoking material retention cartridge becomes centered therein when said bowl selector dial, said smoking material retention cartridge, at least one said wire mesh filter element and said bottom housing are stacked and secured together along a longitudinal axis.

4. The smoking device as recited in claim 1 wherein said bowl selector dial, said smoking material retention cartridge and said bottom housing is made of material selected from a group consisting of ferrous or non-ferrous metals, compressed paper, wood, stone, soapstone, plastic or glass.

5. The smoking device as recited in claim 1 wherein at least one said opening of said smoking material retention cartridge, at least one said annular groove of said bowl selector dial and at least one portion of at least one said groove of said bottom housing is located in equal alignment along a longitudinal axis when said bowl selector dial is adjoined and secured to said bottom housing.

6. The smoking device as recited in claim 1 wherein at least one said flame inlet opening of said bowl selector dial, at least one said opening of said smoking material retention cartridge and at least one portion of at least one said groove of said bottom housing is located in equal alignment along a longitudinal axis when said bowl selector dial is adjoined and secured to said bottom housing.

7. The smoking device as recited in claim 1 wherein said bottom housing is configured to nest at least one said wire mesh filter element and said smoking material retention cartridge therein whereas said top surface of said smoking material retention cartridge sits flush with the top peripheral surface of said bottom housing when said bowl selector dial, said smoking material retention cartridge, at least one said wire mesh filter element and said bottom housing are stacked and secured along a longitudinal axis.

8. The smoking device as recited in claim 1 wherein said smoking device includes at least one neodymium magnet embedded therein said bottom surface of said bowl selector dial and therein said top surface of said smoking material retention cartridge placed in a configuration whereas a field of magnetic repulsion occurs to aid separation of said bowl selector dial from said bottom housing when one said neodymium magnet becomes aligned in direct longitudinal axis over other said neodymium magnet by way of rotation of said bowl selector dial.

9. The smoking device as recited in claim 1 wherein said smoking device has a plurality of bowls of which each singular bowl is equal in volume thereby being configured to provide a proportionally equal and regulated amount of smoke when said plurality of smoking materials placed therein said bowls are individually lit by fire flame and drawn upon by the user.

10. The smoking device as recited in claim 1 wherein said bowl selector dial has a thickness ranging between 0.1 cm and 5.0 cm and a diametric measurement ranging between 5.0 cm and 183.0 cm.

11. The smoking device as recited in claim 1 wherein said draw hole is provided on said peripheral edge of said bowl selector dial and placed diametrically opposite at least one said flame inlet opening.

12. The smoking device as recited in claim 1 wherein at least one said annular groove is provided therein said bottom surface of said bowl selector dial.

13. The smoking device as recited in claim 1 wherein said draw hole, provided on said peripheral edge of said bowl selector dial intersects with at least one said annular groove placed therein said bottom surface of said bowl selector dial.

14. The smoking device as recited in claim 1 wherein at least one said flame inlet opening is placed diametrically opposite said draw hole.

15. The smoking device as recited in claim 1 wherein at least one said flame inlet opening is configured in an orientation perpendicular or angular to the face of said top surface of said bowl selector dial passing through said top surface of said bowl selector dial to said bottom surface of said bowl selector dial being open at each end.

16. The smoking device as recited in claim 1 wherein smoke is drawn from one of the plurality of said smoking material retention bores and passes freely through said draw hole regardless of the rotated position of said bowl selector dial, with exception to at least one non-bored blank position.

17. The smoking device as recited in claim 1 wherein said bowl selector dial is the primary means of bowl selection.

18. The smoking device as recited in claim 1 wherein said bowl selector dial is configured to be transparent or non-transparent.

19. The smoking device as recited in claim 1 wherein said bottom surface of said bowl selector dial provides a bearing surface when placed adjacent to said bottom housing.

20. The smoking device as recited in claim 1 wherein said plurality of smoking material retention bores placed in said smoking material retention cartridge are configured in a generally annular orientation circumferentially around said smoking material retention cartridge spaced equidistantly apart in at least one row and in an orientation perpendicular or angular to the face of the top surface of said smoking material retention cartridge whereas the plurality of said bores are further open at each end.

21. The smoking device as recited in claim 1 wherein the configuration of said bottom housing, at least one said wire mesh filter element, said smoking material retention cartridge and said bowl selector dial permits said smoking material retention bores to be configured in variable sizes, shapes, quantities and rows.

22. The smoking device as recited in claim 1 wherein said smoking material retention cartridge has a thickness ranging between 0.1 cm and 5.0 cm and a diametric measurement ranging between 5.0 cm and 183.0 cm.

23. The smoking device as recited in claim 1 wherein at least one of the plurality of said smoking material retention bore locations is kept blank and non-bored, thereby configured to provide safe containment of said plurality of smoking materials within said smoking device while said smoking device is being transported, stored, or when not in use.

24. The smoking device as recited in claim 1 wherein the plurality of said smoking material retention bores are equal in volume thereby configured to provide a way of equal volume measurement of said smoking material placed therein.

25. The smoking device as recited in claim 1 wherein the plurality of said smoking material retention bores is configured to form a plurality of said tobacco bowls by way of encapsulating at least one end of the plurality of said smoking material retention bores.

26. The smoking device as recited in claim 1 wherein at least one of the plurality of said smoking material retention bores is kept blank and non-bored thereby configured to safely contain the smoking material within the smoking pipe while transporting and/or when not in use.

27. The smoking device as recited in claim 1 wherein the relationship of said bowl selector dial and said smoking material retention cartridge is configured to immediately extinguish open flame or burning embers when at least one said flame inlet of said bowl selector dial is rotated to a centered position over at least one said blank or non-bored position.

28. The smoking device as recited in claim 1 wherein at least one said opening of said smoking material retention cartridge is configured to removably accept the protruding end of at least one said anti-rotation pin partially embedded therein said bottom housing.

29. The smoking device as recited in claim 1 wherein a plurality of said dimple recesses are formed in said top surface of said smoking material retention cartridge and said bottom surface of said smoking material retention cartridge, configured in a generally annular orientation and spaced equidistantly apart being further configured to removably receive a partial surface of at least one said ball bearing embedded therein said bottom surface of said bowl selector dial.

30. The smoking device as recited in claim 1 wherein at least one said dimple recess is configured to prevent unsolicited rotation of said bowl selector dial in relation to said smoking material retention cartridge when said ball bearing becomes engaged with said dimple recess.

31. The smoking device as recited in claim 1 wherein at least one said dimple recess is configured to align and center at least one said flame inlet in direct longitudinal axis over one of the plurality of said smoking material retention bores when said ball bearing becomes engaged with said dimple recess.

32. The smoking device as recited in claim 1 wherein features consisting of bores, groves and dimples of said smoking material retention cartridge are identically configured on both said top surface and said bottom surface of said smoking material retention cartridge thereby arranged for placement within said bottom housing in either direction.

33. The smoking device as recited in claim 1 wherein at least one said wire mesh filter element has a diametric measurement ranging between 5.0 cm and 183.0 cm.

34. The smoking device as recited in claim 1 wherein at least one said wire mesh filter element includes a central aperture forming a toroidal footprint.

35. The smoking device as recited in claim 1 wherein at least one said wire mesh filter element has a circumference that simultaneously covers all of the plurality of said smoking material retention bores placed therein said smoking material retention cartridge without exceeding the outer circumference of said smoking material retention cartridge.

36. The smoking device as recited in claim 1 wherein said central aperture of said wire mesh filter element has a diametric measurement ranging between 0.33 cm and 60.0 cm.

37. The smoking device as recited in claim 1 wherein said wire mesh filter element is configured to retain smoking material and filter smoke from an amount of at least two or more said smoking bowls simultaneously.

38. The smoking device as recited in claim 1 wherein at least one said wire mesh filter element is composed of a material selected from a group consisting of ferrous metals, non-ferrous metals and glass.

39. The smoking device as recited in claim 1 wherein at least one said wire mesh filter element is configured to simultaneously cover two or more said smoking material retention bores when placed adjacent said smoking material retention cartridge thereby forming a plurality of tobacco bowls thereof.

40. The smoking device as recited in claim 1 wherein at least one said wire mesh filter element is configured to simultaneously retain a plurality of said smoking materials and filter smoke produced from said smoking materials when ignited therein without requirement of a turret placed directly adjacent thereto said wire mesh filter element.

41. The smoking device as recited in claim 1 wherein said bottom housing has a thickness ranging between 0.1 cm and 5.0 cm and a diametric measurement ranging between 5.0 cm and 183.0 cm.

42. The smoking device as recited in claim 1 wherein said top inner surface of said bottom housing includes a plurality of said outer grooves and a plurality of said inner grooves formed therein perpendicular to the circumference and spaced equidistantly apart in a generally annular orientation.

43. The smoking device as recited in claim 1 wherein said top inner surface of said bottom housing includes at least one said annular groove formed therein, interconnecting with at least one said inner groove and at least one said outer groove thereby forming at least one smoke passage thereof.

44. The smoking device as recited in claim 1 wherein said bottom housing is configured to leave a thin air gap between said bottom housing and at least one said wire mesh filter element when at least one said wire mesh filter element and said smoking material retention cartridge is placed therein said bottom housing along a longitudinal axis.

45. The smoking device as recited in claim 1 wherein said recessed landing of said bottom housing includes a recession that is equal to the same thickness and diametric measurement as that of at least one said wire mesh filter element.

46. The smoking device as recited in claim 1 wherein at least one said anti-rotation pin, when partially embedded in said bottom housing, is positioned in alignment along a longitudinal axis with at least one said anti-rotation pin receptacle opening formed therein said smoking material retention cartridge when said smoking material retention cartridge is placed therein said bottom housing.

47. The smoking device as recited in claim 1 wherein at least one said neodymium magnet partially embedded therein said central aperture of said bowl selector dial and said central aperture of said bottom housing is configured to magnetically connect at a centered position within said central aperture of said smoking material retention cartridge when said bowl selector dial, said smoking material retention cartridge and said bottom housing are stacked and secured together along a longitudinal axis.

48. The smoking device as recited in claim 1 wherein at least one landing is provided on said top peripheral surface of said bottom housing configured to provide at least one bearing surface between said bowl selector dial and said bottom housing.

* * * * *